United States Patent [19]

Hoshino

[11] Patent Number: 5,063,819

[45] Date of Patent: Nov. 12, 1991

[54] CYMBAL RECEIVING MECHANISM OF HIGH HAT STAND

[75] Inventor: Yoshihiro Hoshino, Nagoya, Japan

[73] Assignee: Hoshino Gakki Co., Ltd., Japan

[21] Appl. No.: 574,276

[22] Filed: Aug. 28, 1990

[30] Foreign Application Priority Data

Mar. 26, 1990 [JP] Japan ..... 2-30801[U]

[51] Int. Cl.[5] ..... G10D 13/02

[52] U.S. Cl. ..... 84/422.3

[58] Field of Search ..... 84/421, 422.1, 422.2, 84/422.3, 422.4

[56] References Cited

U.S. PATENT DOCUMENTS 4,185,808 1/1980 Donohoe et al. ..... 84/421 X

*Primary Examiner*—L. T. Hix

*Assistant Examiner*—Howard B. Blankenship

*Attorney, Agent, or Firm*—Ostrolenk, Faber, Gerb & Soffen

[57] ABSTRACT

In a high hat stand which includes a cymbal with a convex bottom, a cymbal receiving plate having a concave upper surface for receiving the convex cymbal bottom. The plate is journaled to a main receiving body at one side of the center of the plate. An adjustable bolt, for adjusting the pivot orientation around the journal of the plate with respect to the body, is located at the other side of the center of the plate and the body. A cushion is between the plate and the cymbal.

7 Claims, 4 Drawing Sheets

CYMBAL RECEIVING MECHANISM OF HIGH HAT STAND

BACKGROUND OF THE INVENTION

The present invention relates to a cymbal receiving mechanism of a high hat stand and more particularly to means which support and enable adjustable tilting of the supported cymbal.

Generally, a high hat stand comprises two relatively movable, cooperating cymbals, a shaft for moving one of the cymbals and a pedal connected with the one cymbal.

In a conventional high hat stand, a support for a cymbal includes a flat surface plate that is provided on a main receiving body. The receiving body is installed on a stationary pipe on the high hat stand. There may be a cushion between the flat surface of the plate and the cooperating supported surface of the cymbal. Usually, the bottom of the cymbal is convexly curved so that there is a stability problem when the cymbal sits on the flat surface of the plate. Some lifting means, such as an uplifting bolt, tilts the flat surface plate with respect to the body which tilts the cymbal by pushing up one edge of the plate on which the cymbal is seated. In such a case, however, the contact area between the main cymbal receiving body and the plate tends to shift. Maintenance of the orientation of the cymbal becomes unstable and difficult to manage.

SUMMARY OF THE INVENTION

The object of this invention is to improve the stability of a high hat stand, and particularly the support of a cymbal on the stand, to drastically improve the musical performance quality with the cymbal.

A cymbal receiving mechanism of a high hat stand includes a cymbal receiving plate which has a concave shape at one side. The supported cymbal has a convex side, that is, the usually the dish shaped bottom side, of the supported cymbal. That convex side of the cymbal faces the concave side of the plate. At one lateral side, the cymbal receiving plate is journaled on a main receiving body. An uplifting means, e.g. in the form of a bolt, is operable to tilt the cymbal receiving plate. The bolt is located on the opposite side of the plate from the journaled part. The bolt is freely adjustable on the main body.

Other objects and features of this invention are explained below on the basis of the drawings.

DESCRIPTION OF A PREFERRED EMBODIMENT

Figure 1:
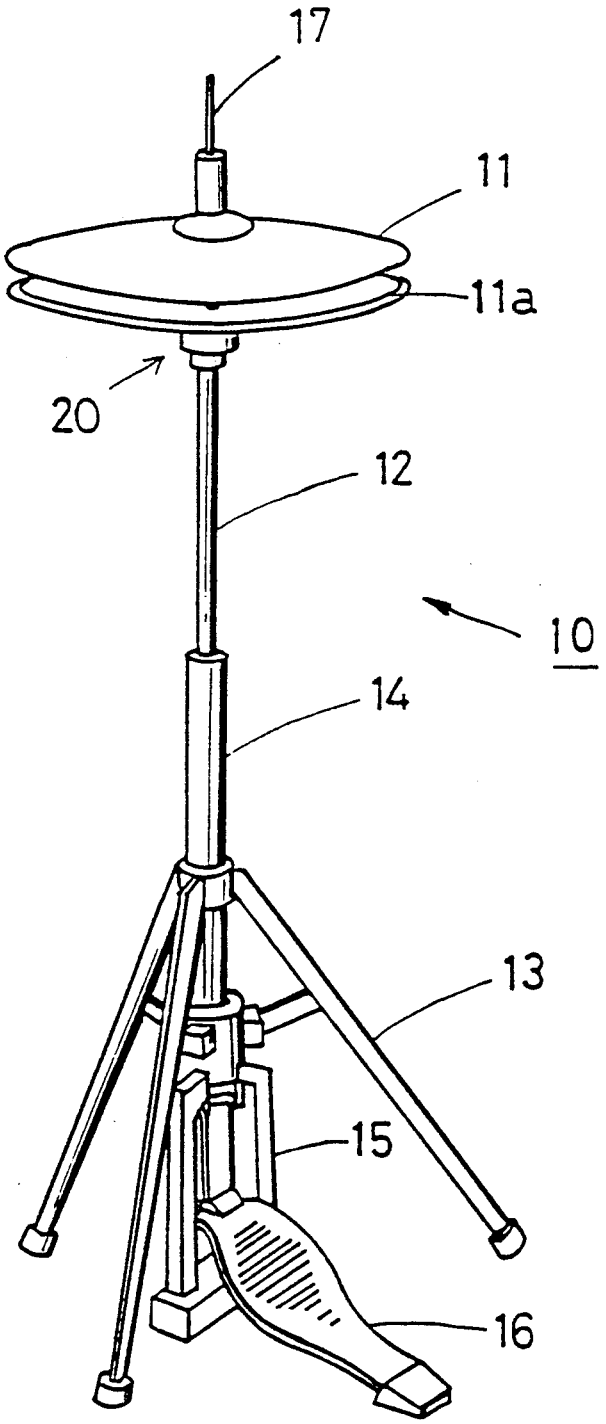
FIG. 1 is an oblique perspective view of a high hat stand in which the invention is incorporated.

A high hat stand 10 shown in FIG. 1 comprises an upper movable cymbal 11, a lower stationary cymbal 11*a*, an internal, longitudinally movable support pipe 12 which supports the lower cymbal 11*a*, an external stationary tube 14 around the pipe 12 and supported on a tripod, and a foot pedal 16 which is connected to the lower end of the operating axis 17 via a connecting member 15 so that the pedal 16 moves the operating axis 17 and upper cymbal 11 up and down.

A cymbal receiving support 20 for stationary lower cymbal 11*a* is provided on top of the pipe 12. The lower cymbal 11*a* is maintained to face open upward. There is a cymbal operating axis 17 on which the movable upper cymbal 11 is supported above the lower cymbal 11*a*.

Figure 2:
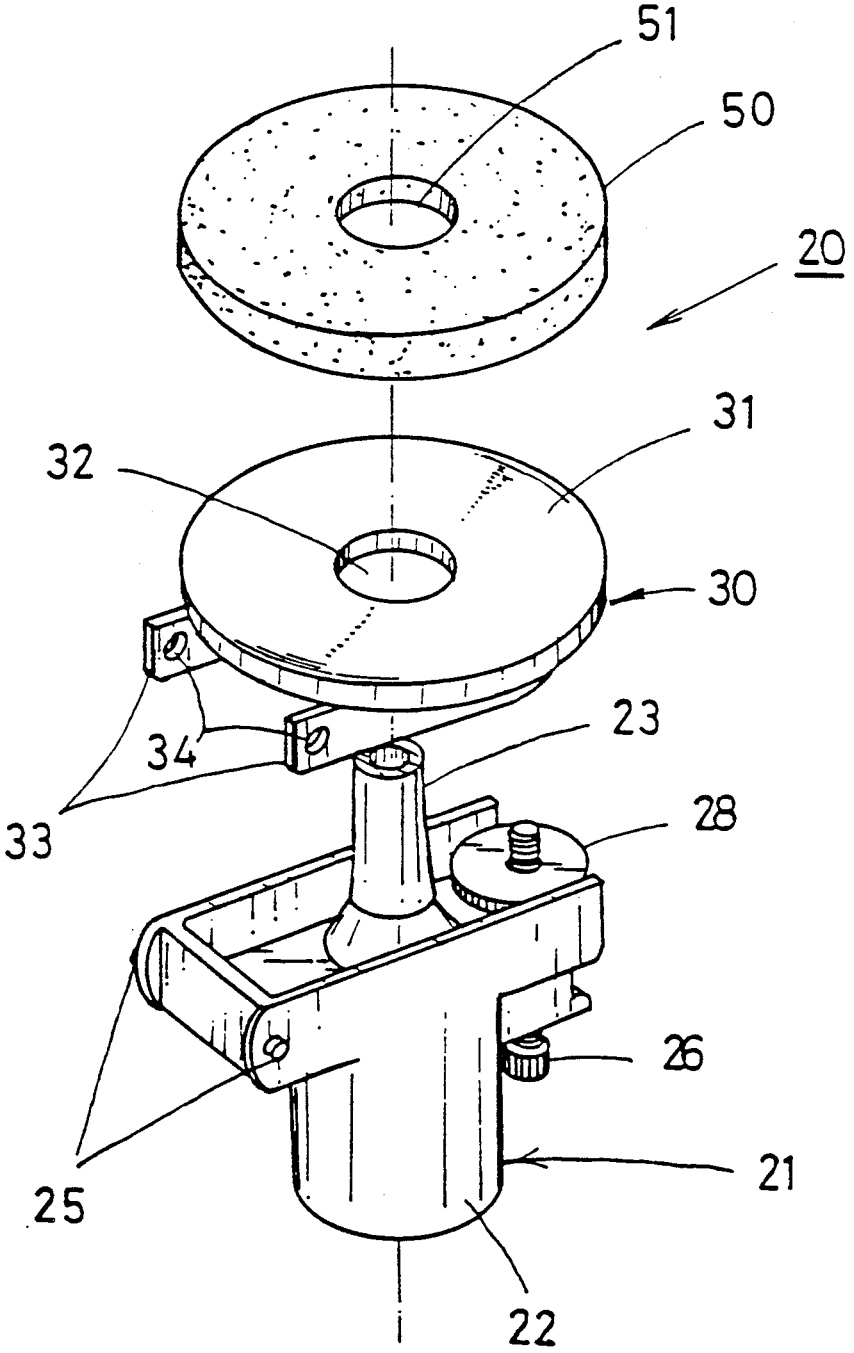
FIG. 2 is an oblique perspective view of the cymbal support of a high hat stand in a dismantled state.

FIG. 2 is an oblique view of the dismantled cymbal support 20 located on the post 12 and for supporting the lower cymbal 11*a*. The cymbal support 20 comprises a main receiving body 21 and a cymbal receiving plate 30 which is held on the receiving body 21 in a freely tiltable manner.

The main receiving body 21 is a closed top tube which receives the end of the pipe 12 in its lower part end. The body 21 has a tubular upper part 23 through which the cymbal operating axis 17 is inserted.

Figure 3:
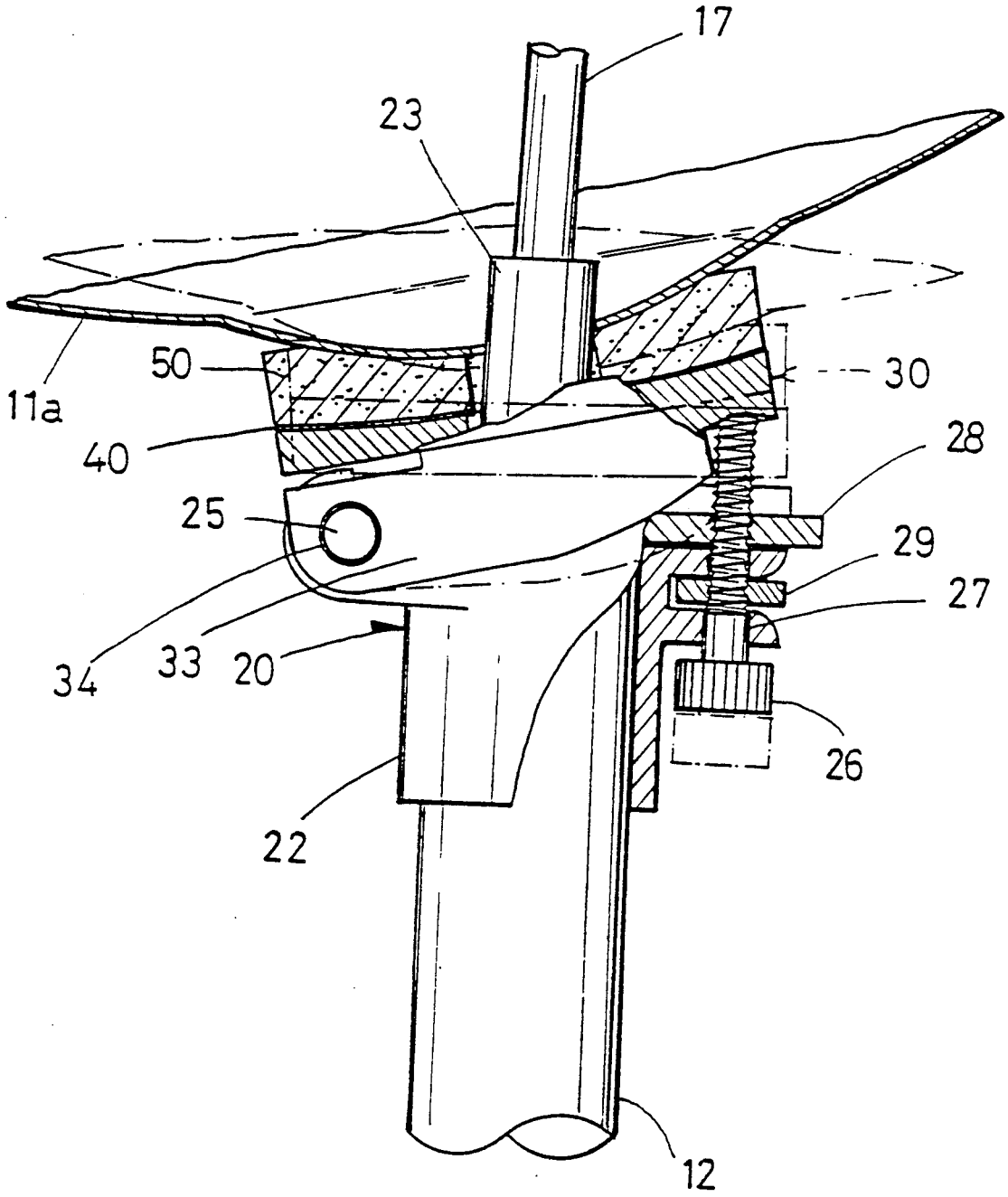
FIG. 3 is a cross section of the cymbal support part in the tilted state.
Figure 4:
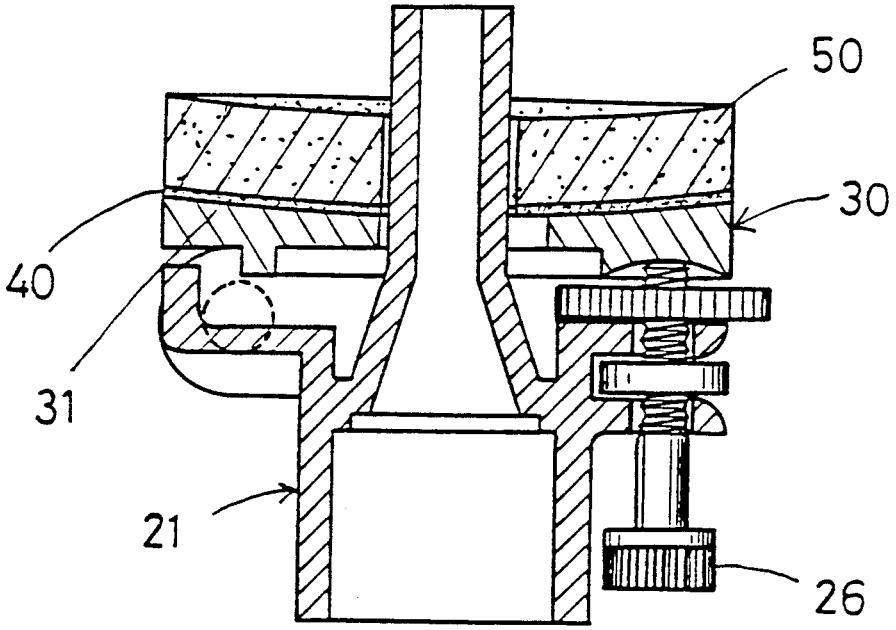
FIG. 4 also is a cross section of the cymbal support.

In FIGS. 3 and 4, a through hole 27 is formed in the main receiving body 21. An uplifting bolt 26 for adjusting the tilt of the lower side cymbal 11*a* is inserted into the hole 27 from the lower side of the main receiving body 21.

By means of lock nut 28, the uplifting bolt 26 is screwed into a selected vertical position which is freely adjustable. The cooperation of nut 28 with nut 29 on opposite sides of a projection from body 21 fix the bolt 26 so as not to be loosened. Pivot axis pins 25 protrude from both sides of the rear end portion of the main receiving body 21.

The cymbal receiving plate 30 has a concavely shaped upwardly facing dish surface 31. This enables the cymbal receiving plate to stably hold the cooperatingly curved convex bottom of the stationary cymbal 11*a*. A central hole 32 through the plate is aligned with and receives in it the tubular part 23 of the main receiving body 21. At the bottom of the cymbal receiving plate 30, there are two arms 33 on the right and the left, which are formed integrally as one body, and there are axial holes 34 in the arms 33 that are engaged with the pins on the body 21.

FIG. 3 is a cross section of the cymbal support in the tilted state. The cymbal receiving plate 30 is journaled on the main receiving body 20 to be freely movable vertically, with pivot connection at holes 34 and pins 25. The cymbal receiving plate 30 is pivoted to a tilted orientation and is then held there by the uplifting bolt 26 that has been inserted from the through hole 27, and locked there by the lock nut 28 and the nut 29.

A cushion 50 comprised of felt, or the like, is attached by an adhesive layer on the cymbal receiving plate 30. The cushion 50 has a central hole 51, through which the tubular portion 23 of the body 21 is inserted.

Since the plate is journaled on the main receiving body, the cymbal does not shake when the cymbal is tilted during the performance, which can markedly improve the performance. Since the main body and plate are held together integrally, there is no danger of dropping or loss at the time of transportation.

Figure 5:
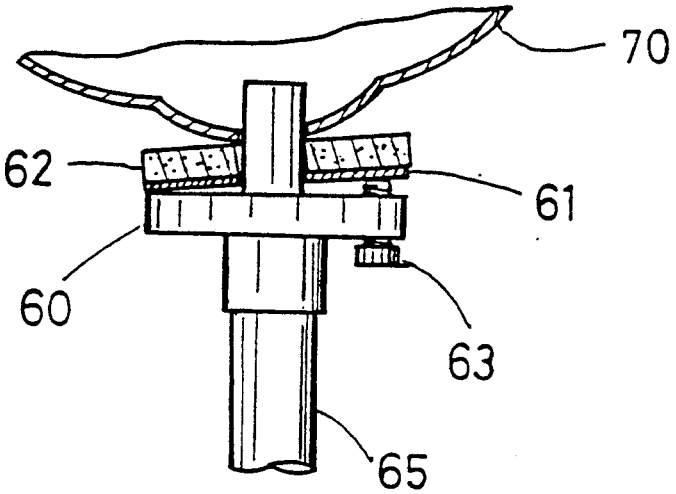
FIG. 5 PRIOR ART
FIG. 5 is a cross section of a prior art cymbal support.

A cymbal support of a conventional high hat stand is shown in FIG. 5. A flat plate is provided on a main receiving body 60. That body is installed on a stationary pipe 65. The cymbal 70 is supported on a cushion 62 of felt, etc. Where a generally disshaped or convex cymbal 70 has its bottom placed on a flat plate 61, a problem in the stability of the cymbal has been experienced. When the cymbal is tilted on the stand for convenience of use, it has been necessary to screw an uplifting bolt 63 to the aforementioned receiving body 60, to tilt the cymbal 70 by pushing up one edge of the plate 61. In such a case, however, the contact surface between the main cymbal receiving body and the plate tends to move. As a result, maintenance of the cymbal orientation becomes more unstable. The invention overcomes these problems with the prior art.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A cymbal receiving mechanism for a high hat stand, wherein the cymbal to be received has a bottom side that is generally convex in shape, the mechanism comprising:

a cymbal receiving plate having a cymbal receiving side which is generally concavely shaped to receive the convex side of the cymbal;

a main receiving body disposed on the opposite side of the cymbal receiving plate from the concave cymbal receiving side;

the body, the cymbal receiving plate and the cymbal having a center;

a pivot journal between the cymbal receiving plate and the main receiving body such that the cymbal receiving plate may be pivoted to different tilt orientations with respect to the body, and tilting means between the body and the plate for tilting the plate around the journal with respect to the main body to a selected extent of tilt.

2. The cymbal receiving mechanism of claim 1, wherein the tilting means comprises an uplift bolt extending between the plate and the body for tilting the plate with respect to the body as the bolt is adjusted.

3. The cymbal receiving mechanism of claim 2, wherein the bolt is on the opposite side of the body and the plate from the journal thereon.

4. The cymbal receiving mechanism of claim 1, wherein the tilting means is on the opposite side of the body and the plate from the journal thereon.

5. The cymbal receiving mechanism of claim 1, further comprising a cushion on the concave side of the plate between the convex side of the cymbal and the concave side of the plate.

6. The cymbal receiving mechanism of claim 1, further comprising a post extending up from the body at a height to extend past the plate and the cymbal, a hole in the center of the plate for the post to extend through, the hole being the size sufficient that the tilting of the plate will not interfere with the post.

7. The cymbal receiving mechanism of claim 1, further comprising the high hat stand having a base and the body being carried on the base;

a second cymbal supported to the base and means for moving the second cymbal into contact with the first cymbal on the cymbal receiving mechanism.

* * * * *